US005577359A

United States Patent [19]

McClanahan

[11] Patent Number: 5,577,359

[45] Date of Patent: Nov. 26, 1996

[54] FLOOR SQUEAK ELIMINATOR

[76] Inventor: John D. McClanahan, 6536 Williamsburg Blvd., Arlington, Va. 22213

[21] Appl. No.: 494,400

[22] Filed: Jun. 26, 1995

[51] Int. Cl.[6] ..... E04G 23/00

[52] U.S. Cl. ..... 52/291; 52/514

[58] Field of Search ..... 52/514, 480, 741.3, 52/745.21, 698, 703, 291; 411/386, 389, 426, 412

[56] References Cited

U.S. PATENT DOCUMENTS

| | | | |
|---|---|---|---|
| 3,940,941 | 3/1976 | Libert et al. | 411/386 X |
| 4,888,926 | 12/1989 | Lutz, III | 52/291 |
| 5,179,813 | 1/1993 | Martinsen et al. | 52/514 X |
| 5,372,466 | 12/1994 | O'Berry | 52/98 X |

FOREIGN PATENT DOCUMENTS

| | | | |
|---|---|---|---|
| 0484654 | 5/1938 | United Kingdom | 411/389 |

*Primary Examiner*—Michael Safavi
*Assistant Examiner*—Timothy B. Kang

[57] ABSTRACT

A floor squeak eliminator system comprising a cylindrical rod having an upper end and a lower end. A threaded exterior is formed into the upper end. The extreme upper end is formed with a point for penetrating into a squeaking floor. The lower end of the cylindrical rod has a threaded exterior surface through an aperture in a support plate. The support plate is mounted beneath the area of the floor for having its squeak removed. A nut is threadably received on the lower edge of the exterior surface of the rod with a washer thereabove. A section is formed in the rod of reduced area adjacent to the upper edge of the rod immediately beneath the upper threaded section.

1 Claim, 4 Drawing Sheets

FLOOR SQUEAK ELIMINATOR

BACKGROUND OF THE INVENTION

1. Field of the Invention

The present invention relates to a floor squeak eliminator and more particularly pertains to eliminating squeaky floors in homes and buildings through the use of a simplified rod and brace device system.

2. Description of the Prior Art

The use of devices for eliminating squeaks in wooden surfaces of a wide variety of designs and configurations is known in the prior art. More specifically, devices for eliminating squeaks in wooden surfaces of a wide variety of designs and configurations heretofore devised and utilized for the purpose of eliminating squeaky areas in constructed members through a wide variety of methods and apparatuses are known to consist basically of familiar, expected and obvious structural configurations, notwithstanding the myriad of designs encompassed by the crowded prior art which have been developed for the fulfillment of countless objectives and requirements.

By way of example, the prior art discloses in U.S. Pat. No. 3,900,541 to Klapwijk discloses a method of restoring a wooden beam.

U.S. Pat. No. 5,179,813 to Martinsen et al., discloses repairing squeaking floors.

U.S. Pat. No. 4,888,926 to Lutz, III, discloses a floor squeak eliminator.

U.S. Pat. No. 5,254,203 to Corston discloses a method and apparatus for construction of flooring to prevent squeaks.

Lastly, U.S. Pat. No. 4,644,720 to Schneider discloses a hardwood flooring system.

In this respect, the floor squeak eliminator according to the present invention substantially departs from the conventional concepts and designs of the prior art, and in so doing provides an apparatus primarily developed for the purpose of eliminating squeaky floors in homes and buildings through the use of a simplified rod and brace device system.

Therefore, it can be appreciated that there exists a continuing need for a new and improved floor squeak eliminator which can be used for eliminating squeaky floors in homes and buildings through the use of a simplified rod and brace device system. In this regard, the present invention substantially fulfills this need.

SUMMARY OF THE INVENTION

In view of the foregoing disadvantages inherent in the known types of devices for eliminating squeaks in wooden surfaces of a wide variety of designs and configurations now present in the prior art, the present invention provides an improved floor squeak eliminator. As such, the general purpose of the present invention, which will be described subsequently in greater detail, is to provide a new and improved floor squeak eliminator apparatus and method which has all the advantages of the prior art and none of the disadvantages.

To attain this, the present invention essentially comprises a new and improved floor squeak eliminator system, comprising, in combination, a cylindrical rod having an upper end and a lower end and an intermediate extent therebetween. A threaded exterior surface is formed into the upper end, The extreme upper end is formed with a point for penetrating into a squeaking floor. The lower end of the cylindrical rod has a threaded exterior surface positionable through an aperture in a support plate. The support plate is mounted beneath the area of the floor for having its squeak removed. Vertical side braces couple the upper edges of the support plate with the lower surface of the floor to be fixed. A nut is threadably received on the lower exterior surface of the rod with a washer thereabove for contacting the lower surface of the support plate. A square section is formed in the rod adjacent to its upper end of reduced diameter adjacent to the upper edge of the rod immediately beneath the upper threaded section.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved floor squeak eliminator which has all the advantages of the prior art devices for eliminating squeaks in wooden surfaces of a wide variety of designs and configurations and none of the disadvantages.

It is another object of the present invention to provide a new and improved floor squeak eliminator which may be easily and efficiently manufactured and marketed.

It is a further object of the present invention to provide a new and improved floor squeak eliminator which is of a durable and reliable construction.

An even further object of the present invention is to provide a new and improved floor squeak eliminator which is susceptible of a low cost of manufacture with regard to both materials and labor, and which accordingly is then susceptible of low prices of sale to the consuming public, thereby making such devices for eliminating squeaks in wooden surfaces of a wide variety of designs and configurations economically available to the buying public.

Still yet another object of the present invention is to provide a new and improved floor squeak eliminator which provides in the apparatuses and methods of the prior art some of the advantages thereof, while simultaneously overcoming some of the disadvantages normally associated therewith.

Still another object of the present invention is to eliminate squeaky floors in homes and buildings through the use of a simplified rod and brace device system.

Lastly, it is an object of the present invention to provide a new and improved floor squeak eliminator system comprising a cylindrical rod having an upper end and a lower end. A threaded exterior is formed into the upper end. The extreme upper end is formed with a point for penetrating into a squeaking floor. The lower end of the cylindrical rod has a threaded exterior surface through an aperture in a support plate. The support plate is mounted beneath the area of the floor for having its squeak removed. A nut is threadably received on the lower edge of the exterior surface of the rod with a washer thereabove. A section is formed in the rod of reduced diameter adjacent to the upper edge of the rod immediately beneath the upper threaded section.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
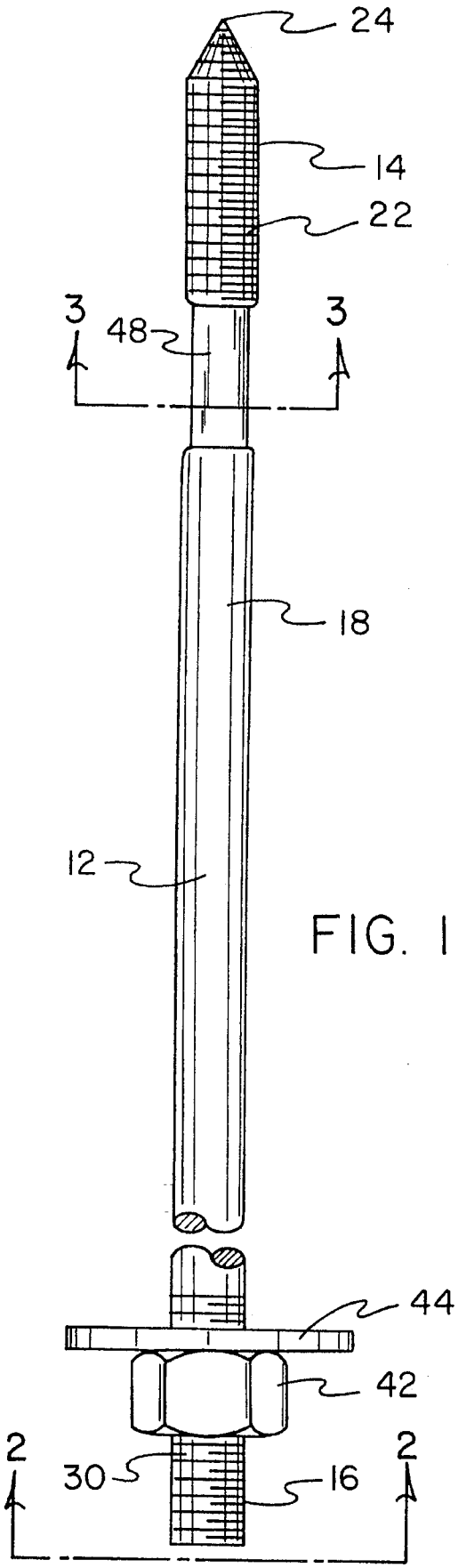
FIG. 1 is an enlarged side elevational view of the preferred embodiment of the floor squeak eliminator constructed in accordance with the principles of the present invention.
Figure 2:
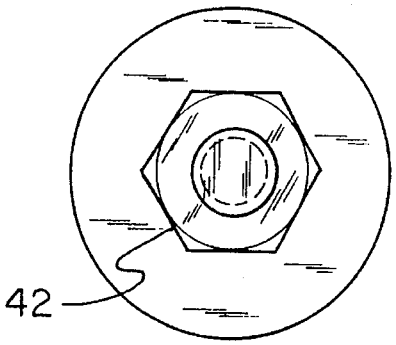
FIG. 2 is a top elevational view of the apparatus shown in FIG. 1 taken along line 2—2 of FIG. 1.
Figure 3:
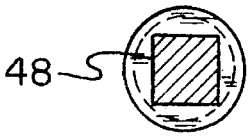
FIG. 3 is a cross sectional view taken along line 3—3 of FIG. 1.
Figure 4:
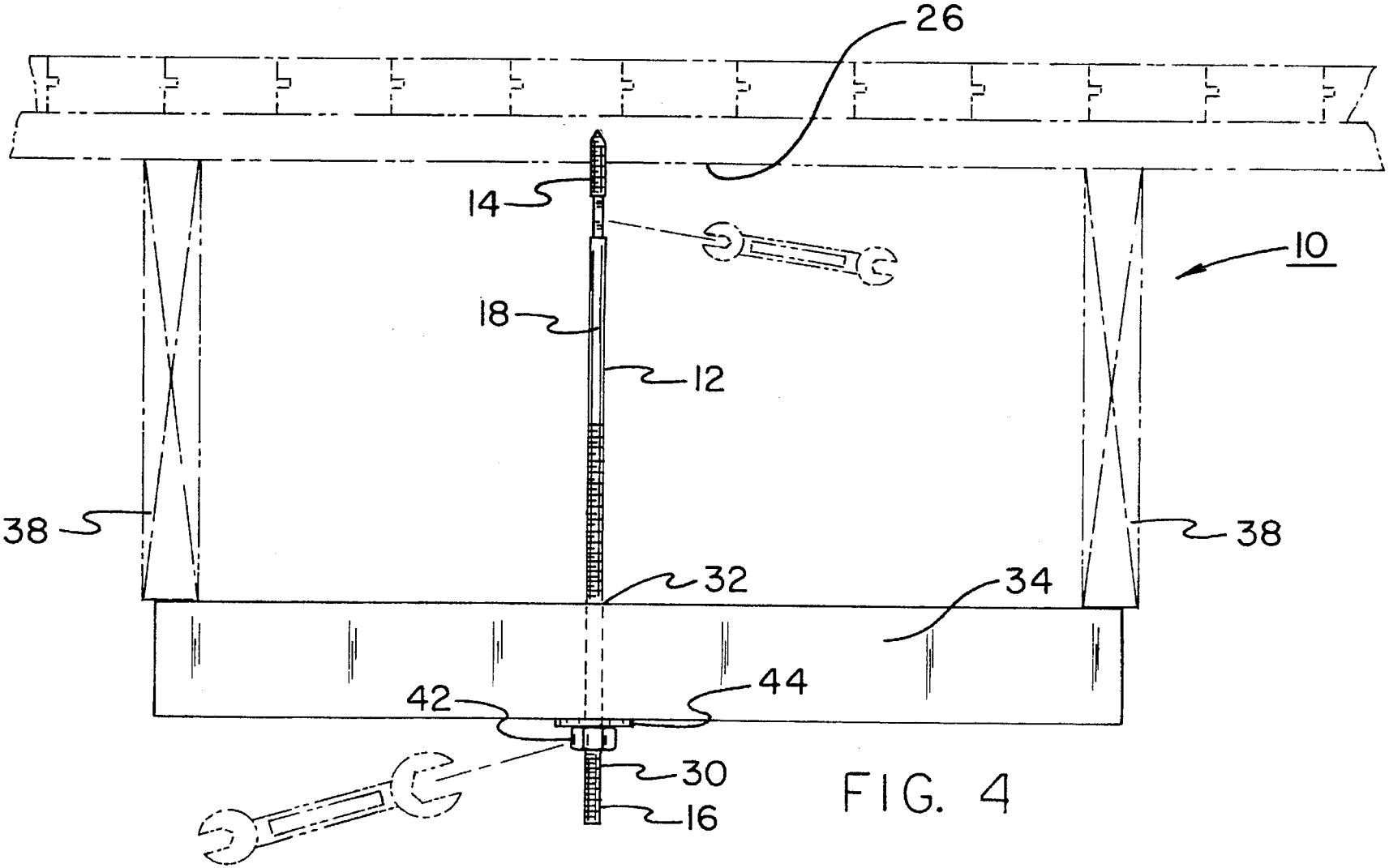
FIG. 4 is a side elevational view of the apparatus of the prior Figures shown in operative position.
Figure 5:
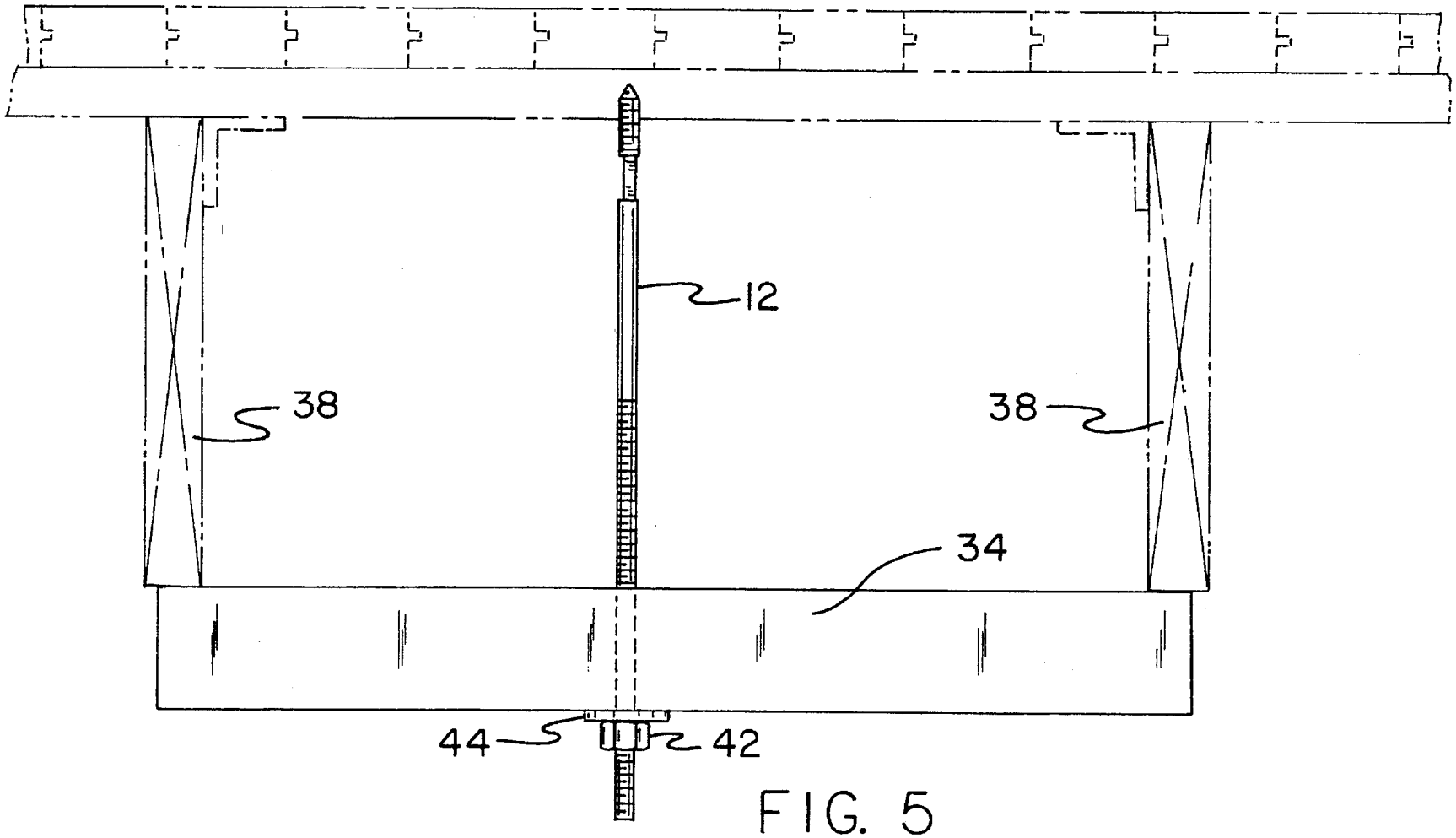
FIG. 5 is a view similar to that of FIG. 4, but with the adjusting mechanisms removed.
Figure 6:
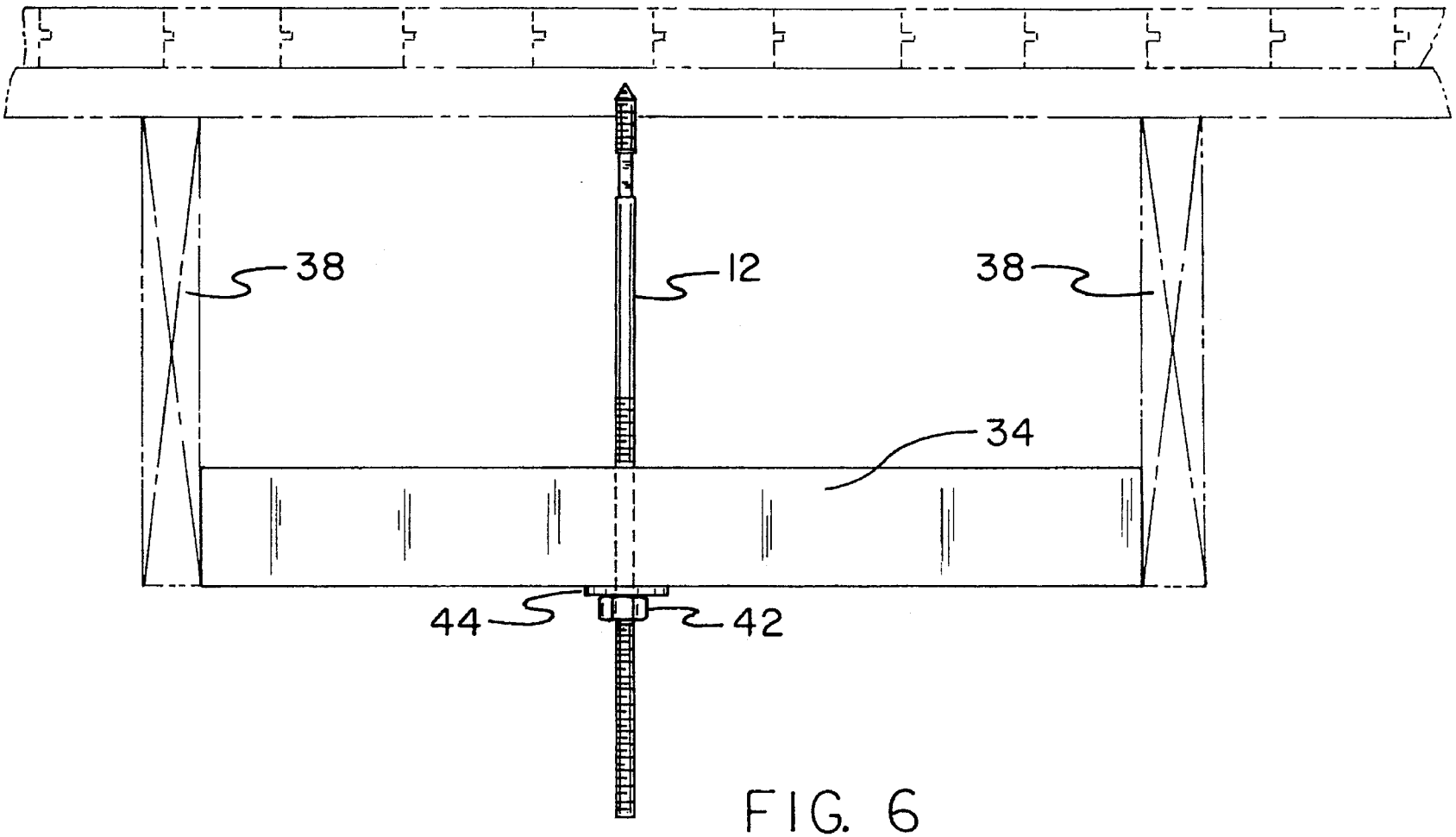
FIG. 6 is a side elevational view of the apparatus of FIG. 4 installed permanently.

With reference now to the drawings, and in particular to FIG. 1 thereof, a new and improved floor squeak eliminator embodying the principles and concepts of the present invention and generally designated by the reference numeral 10 will be described.

The present invention, the new and improved floor squeak eliminator, is comprised of a plurality of components. Such components in their broadest context include a cylindrical rod, a threaded exterior, an upper end, a threaded lower end, vertical side braces, a nut and a square section. Such components are individually configured and correlated with respect to each other so as to attain the desired objective.

More specifically, the present floor squeak illuminator is a system 10. Its central component is a cylindrical rod 12, as shown in FIG. 1. Such rod has an upper end 14 and a lower end 16. An intermediate extent 18 is located between the upper and lower ends.

On the upper end of the rod is a threaded exterior surface 22. Such surface is formed into the upper end. It is also formed with an extreme upper end being formed with a point 24. Such point and associated threads are for penetrating into the squeaking floor, or existing subflooring 26 from the lowermost surface thereof.

The lower end of the cylindrical rod 12 is formed with a threaded exterior surface 30 in a cylindrical configuration. It is positionable through an aperture 32 in a support plate 34. Such support plate is parallel to and beneath the squeaking floor. The support plate is mounted beneath the area of the floor having its squeak intended to be removed.

Vertical side braces 38 are also provided and are the excisting floor joist of the existing subflooring. Such braces are at upper and lower ends for coupling the upper edges of the support plate with the lower surface of the floor to be fixed.

Next provided is a nut 42. Such nut is threadedly received at the lower exterior surface of the rod. Rotation thereof will allow axial movement upwardly and downwardly of the nut. A washer 44 is located above the nut for contacting the lower surface of the support plate to effect its movement in a vertical direction.

Lastly provided is a square section 48. Such section is formed into the rod adjacent to its upper end. It is of a reduced area and is located adjacent to the upper edge of the rod immediately beneath the upper threaded section.

A rod and brace device designed to eliminate squeaky floors in homes and building. The device consists of a 14 inch metal rod with wood screw threads on one end and machine screw threads on the other end. The rod has ¼ inch flat section that allow tightening with a wrench. An alternative arrangement could include a flat plate with a row of holes along its length and machine threads in the center hole. The rod used with this plate would have machine screws on both ends.

To fix a squeak in one subflooring floorboard, a pilot hole is drilled in the sub-flooring and the rod end with the wood threads is screwed into this hole. A section of 2×4 inch lumber is positioned across the floor joists, or vertical side brace with its 4 inch dimension in the vertical position. The other end of the rod is guided through a hole in the center of this section and the flat washer and nut are attached. This pulls the sub-flooring down tightly, eliminating the squeak. The angle sections permanently fasten the floorboard to the sides of the joints. To fix a squeak in more than one floorboard, the plate is attached to all the boards that squeak and the rod is attached to the center hole and fastened to the 2×4. The entire assembly is left in place. This device eliminates floor squeaking by pulling the subflooring down against two joists instead of only one. It is simple to install and does not require any special tools.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved floor squeak eliminator system, comprising, in combination:

a cylindrical rod having an upper end and a lower end and an intermediate extent therebetween;

a threaded exterior surface formed into the upper end of the rod, with an extreme upper end being formed with a point for penetrating into an existing subflooring from a lowermost surface thereof;

a square section formed into the rod adjacent to its upper end, the square section being of reduced area and adjacent to an upper edge of the rod immediately beneath an upper threaded section, the square section capable of being engaged by a wrench for allowing penetration of the extreme upper end of the rod into the lowermost surface of the squeaking floor;

the lower end of the cylindrical rod having a threaded exterior surface beginning where the lower end and intermediate extent interconnect, the threaded exterior surface of the lower end being positionable through an aperture in a support plate, the support plate being mounted beneath the area of the floor for having its squeak removed, the support plate being capable of being in contact with an existing floor joist of the subflooring when the rod is secured to the subflooring;

the existing floor joist of the subflooring allow coupling of upper edges of the support plate with the lower surface of the floor to be fixed; and a nut threadably received on a lower exterior surface of the rod with a washer thereabove for contacting the lower surface of the support plate, the nut being rotatable for axial movement upwardly and downwardly, the nut being rotated and capable of pulling the squeaking floor downwardly for elimination of a squeak.

* * * * *